US009422792B2

(12) United States Patent
Geoffroy

(10) Patent No.: US 9,422,792 B2
(45) **Date of Patent: *Aug. 23, 2016**

(54) WASHPIPE ISOLATION VALVE AND ASSOCIATED SYSTEMS AND METHODS

(71) Applicant: HALLIBURTON ENERGY SERVICES, INC., Houston, TX (US)

(72) Inventor: Gary J. Geoffroy, Plano, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 183 days.

This patent is subject to a terminal disclaimer.

(21) Appl. No.: 13/973,368

(22) Filed: Aug. 22, 2013

(65) Prior Publication Data

US 2013/0333887 A1 Dec. 19, 2013

Related U.S. Application Data

(63) Continuation of application No. 13/474,571, filed on May 17, 2012, now Pat. No. 8,813,850.

(51) Int. Cl.

| | |
|---|---|
| ***E21B 34/06*** | (2006.01) |
| ***E21B 43/04*** | (2006.01) |
| ***E21B 34/12*** | (2006.01) |
| ***E21B 21/10*** | (2006.01) |

(52) U.S. Cl.

CPC ..... *E21B 43/04* (2013.01); *E21B 21/10* (2013.01); *E21B 34/12* (2013.01)

(58) Field of Classification Search

CPC ..... E21B 34/06; E21B 43/04; E21B 43/045; E21B 43/08

See application file for complete search history.

(56) References Cited

U.S. PATENT DOCUMENTS

| | | | | |
|---|---|---|---|---|
| 4,733,723 | A | 3/1988 | Callegari, Sr. | |
| 4,858,690 | A | 8/1989 | Rebardi et al. | |
| 7,128,151 | B2 | 10/2006 | Corbett | |
| 7,523,787 | B2 | 4/2009 | Richards et al. | |
| 8,813,850 | B2 * | 8/2014 | Geoffroy | 166/334.1 |
| 2011/0048705 | A1 | 3/2011 | Clem et al. | |
| 2011/0067862 | A1 | 3/2011 | Clem et al. | |

OTHER PUBLICATIONS

International Search Report and Written Opinion issued Apr. 30, 2013 for PCT Patent Application No. PCT/US2012/040657, 11 pages.

Office Action issued Aug. 13, 2013 for U.S. Appl. No. 13/474,571, 17 pages.

* cited by examiner

*Primary Examiner* — Catherine Loikith

(74) *Attorney, Agent, or Firm* — Locke Lord LLP; Peter Fallon; Joshua L. Jones

(57) ABSTRACT

A method can include closing a valve interconnected between sections of a washpipe of a service tool string by displacing the service tool string relative to a completion string, thereby preventing flow through the washpipe. A well system can include a service tool string reciprocably received in a completion string, the service tool string including a washpipe received in a well screen, and a valve which selectively permits and prevents flow through the washpipe. The completion string can include a structure which operates the valve in response to displacement of the service tool string relative to the completion string. Another method can include closing a valve by partially withdrawing a service tool string from a completion string, thereby preventing flow through a washpipe of the service tool string.

15 Claims, 7 Drawing Sheets

WASHPIPE ISOLATION VALVE AND ASSOCIATED SYSTEMS AND METHODS

CROSS-REFERENCE TO RELATED APPLICATION

The present application is a continuation of U.S. application Ser. No. 13/474,571 filed on 17 May 2012. The entire disclosure of this prior application is incorporated herein by this reference.

BACKGROUND

This disclosure relates generally to equipment utilized and operations performed in conjunction with a subterranean well and, in an example described below, more particularly provides a washpipe isolation valve system and method.

Washpipes are used in well screens to deflect and direct fluid which flows inward through the well screens during, for example, gravel packing and fracturing operations. A washpipe can typically be manipulated, or pressure can be applied to operate a valve, so that flow into the well screens is prevented (e.g., in fracturing or other stimulation operations), in order to force the flow into an earth formation surrounding a well screen.

Therefore, it will be appreciated that improvements are continually needed in the art of constructing and operating washpipe systems.

SUMMARY

In the disclosure below, systems and methods are provided which bring improvements to the art. One example is described below in which a valve is interconnected between opposite ends of a washpipe. Another example is described below in which the valve is operated by picking up on a service tool string, thereby closing the valve and configuring the service tool string for a squeeze operation.

A method described below can comprise closing a valve interconnected between sections of a washpipe of a service tool string by displacing the service tool string relative to a completion string, thereby preventing flow through the washpipe.

In one example, a well system can comprise a service tool string reciprocably received in a completion string. The service tool string may include a washpipe received in a well screen, and a valve which selectively permits and prevents flow through the washpipe. The completion string can include a structure which closes the valve in response to displacement of the service tool string relative to the completion string. Once closed, the valve cannot be reopened in the system.

In another example, a method described below can comprise closing first and second valves by partially withdrawing a service tool string from a completion string, thereby preventing flow through a washpipe of the service tool string; and then opening the second valve, but not the first valve, by inserting the service tool string further into the completion string.

These and other features, advantages and benefits will become apparent to one of ordinary skill in the art upon careful consideration of the detailed description of representative examples below and the accompanying drawings, in which similar elements are indicated in the various figures using the same reference numbers.

DETAILED DESCRIPTION

Figure 1:
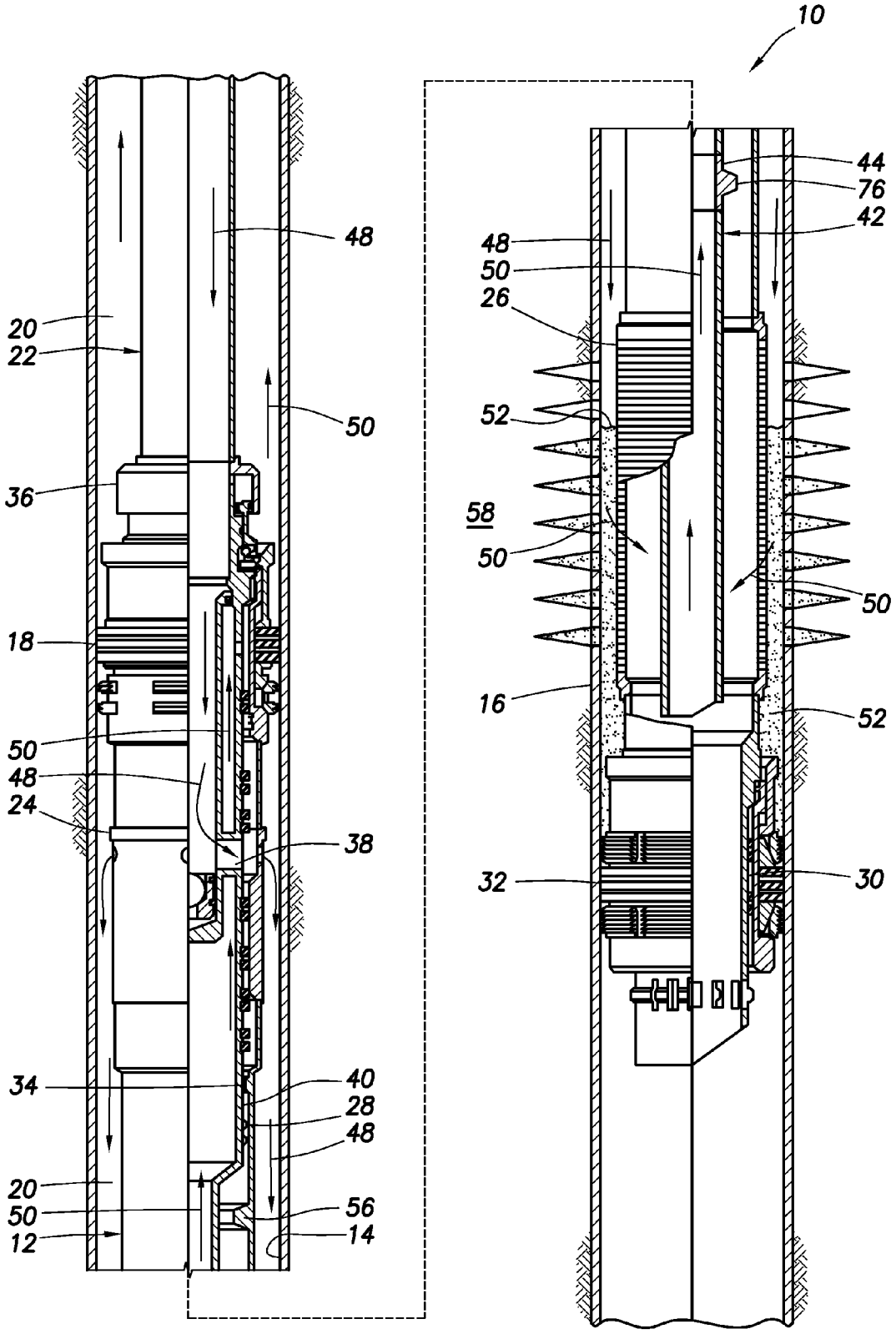
FIGS. 1 & 2 are representative partially cross-sectional views of a system for use with a well, and steps of an associated method, which system and method can embody principles of this disclosure.

Representatively illustrated in FIG. 1 is a system 10 for use with a subterranean well, and an associated method, which system and method can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

In the FIG. 1 example, a generally tubular completion string 12 is positioned in a wellbore 14 lined with casing 16. The casing 16 is preferably cemented, although the cement is not shown in FIG. 1. In other examples, the casing 16 may not be cemented (e.g., the casing could be expanded or formed in situ, etc.), or may not be used (e.g., the wellbore 14 could be uncased or open hole).

The completion string 12 includes a special gravel pack packer 18, which seals off an annulus 20. The packer 18 isolates the annulus 20 below the packer (the annulus below the packer being formed radially between the completion string 12 and the wellbore 14) from the annulus above the packer (the annulus above the packer being formed radially between a generally tubular service tool string 22 and the wellbore).

The completion string 12 also includes a closing sleeve 24 which selectively permits and prevents flow through a side wall of the completion string, one or more well screen 26 which filter fluid flowing into the completion string, and a seal stinger 30 which is sealingly received in a sump packer 32. The packers 18, 32 isolate a section of the annulus 20 between them.

The service tool string 22 is used to convey the completion string 12 into the wellbore 14, to set the packer 18, and to selectively engage the completion string so that various operations can be performed. Eventually, the service tool string 22 is completely withdrawn from the completion string 12 and retrieved from the wellbore 14, and a production tubing string (not shown) is stabbed into the packer 18 for production of fluids from the well.

The service tool string 22 includes a multi-position service tool 36, a crossover 38, a valve 40 and a washpipe 42. The multi-position service tool 36 is of a type well known to those skilled in the art, and is used for setting the packer 18 and controlling flow between the service tool string 22 and the annulus 20 above and/or below the packer.

The crossover 38 directs flow between an interior of the service tool string 22 above the crossover and an exterior of the completion string 12, and directs flow between the interior of the service tool string below the crossover and the annulus 20 above the packer 18 (via the service tool 36). These flows are segregated from each other in the crossover 38, with one being generally radially directed and the other being generally longitudinally directed in the crossover.

The valve 40 selectively permits and prevents flow between the interior of the washpipe 42 and the crossover 38. A suitable valve for use as the valve 40 is the ROC™ Reverse-Out Check Tool marketed by Halliburton Energy Services, Inc. of Houston, Tex. USA.

The valve 40 is initially open as depicted in FIG. 1. To close the valve 40, the service tool string 22 can be raised sufficiently for an engagement structure 28 (such as collets, etc.) on the valve to engage an internal profile 34 in the completion string 12. Of course, other types of valves, and other techniques for operating those valves, may be used within the scope of this disclosure.

The washpipe 42 receives fluid that passes inward through the well screen 26. The washpipe 42 includes a valve 44 interconnected in the washpipe between its opposite ends. As viewed in FIG. 1, the valve 44 is positioned somewhat above the well screen 26, but in other examples the valve could be positioned within the well screen or in another position. The valve 44 is used to selectively permit and prevent flow through the washpipe 42, as described more fully below.

A slurry 48 (which may comprise gravel, proppant, etc.) is pumped from the surface, through the interior of the service tool string 22, outward through the crossover 38 and closing sleeve 24, and into the annulus 20 about the well screen 26. The valves 40, 44 are both open at this point.

A fluid 50 portion of the slurry 48 flows from the annulus 20 inward through the screen 26, into the washpipe 42 (with the valve 44 being open), through the open valve 40, crossover 38 and service tool 36 to the annulus 20 above the packer 18 for circulation to the surface. In this manner, gravel 52 is deposited in the annulus 20 about the screen 26.

The FIG. 1 position of the service tool string 22 may be referred to as a "circulate" position, since the fluid 50 is allowed to circulate downward through the service tool string as part of the slurry 48, and then back upward through the annulus 20 via the screen 26, crossover 38, etc. If sufficient pressure is applied, fractures 60 (see FIG. 6) could be formed into the formation 58, although the forming of fractures is not necessary in keeping with the scope of this disclosure.

Figure 2:
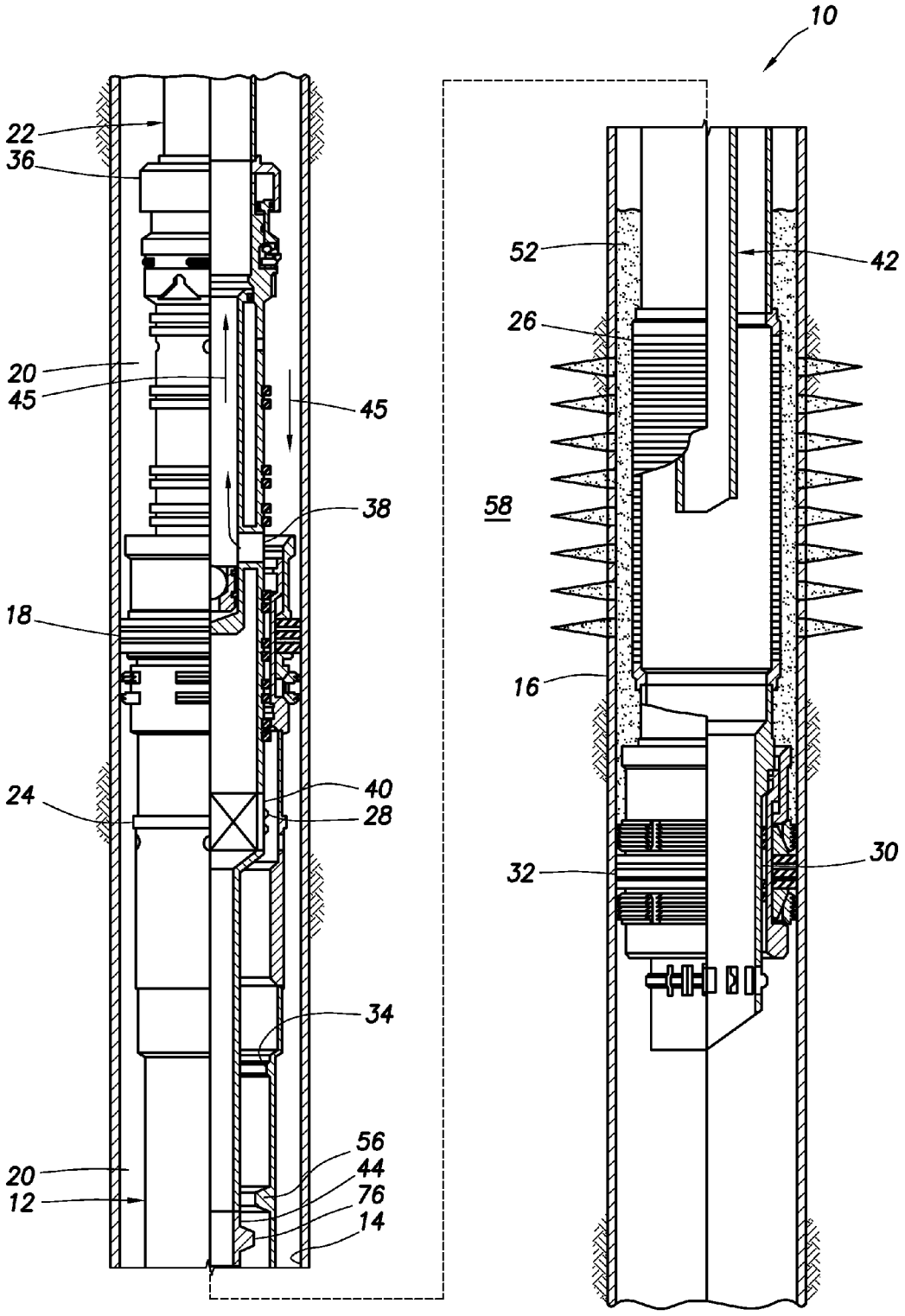

In FIG. 2, the service tool string 22 has been raised relative to the completion string 12, so that the engagement structure 28 passes upwardly through the internal profile 34, thereby closing the valve 40. In addition, this raised "reverse" position of the service tool string 22 exposes the crossover 38 ports to the annulus 20 above the packer 18.

Relatively clean fluid 45 can now be flowed down the annulus 20 from the surface, inward through the crossover 38, and then upward through the service tool string 22 to the surface, in order to flush any excess proppant, gravel, etc. from the system 10. The closed valve 40 prevents the fluid 45 from being pumped down into the washpipe 42 (via the longitudinal passages in the crossover 38) and outward through the screen 26 into a formation 58 surrounding the wellbore 14.

Figure 3:
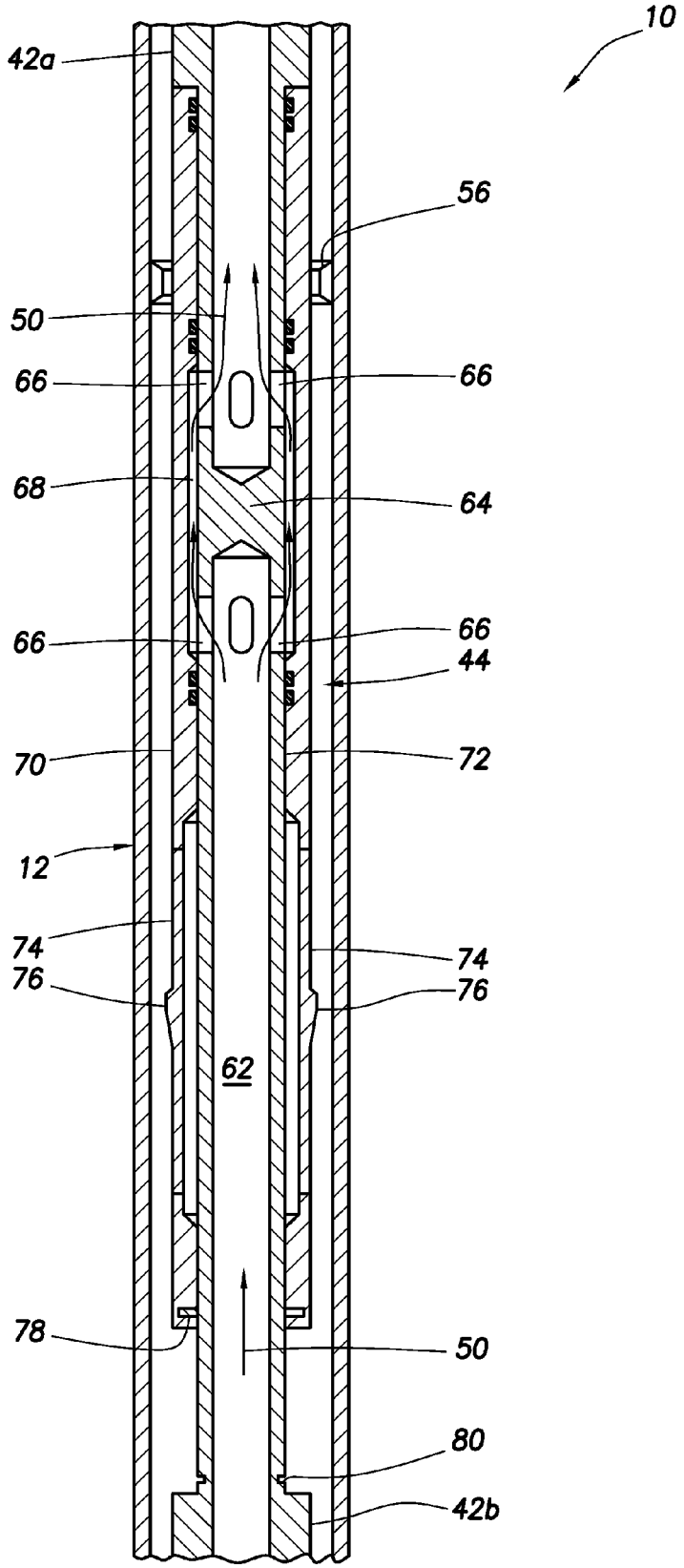
FIG. 3 is an enlarged scale representative cross-sectional view of a portion of a completion string and a service tool string which may be used in the system and method of FIGS. 1 & 2.

Referring additionally now to FIG. 3, a more detailed cross-sectional view of the valve 44 is representatively illustrated. The valve 44 is depicted in an open configuration in FIG. 3.

A flow passage 62 extends longitudinally through the valve 44, but the passage is partially blocked by a bulkhead 64. In the FIG. 3 configuration, flow can bypass the bulkhead via openings 66 on opposite sides of the bulkhead, and an annular space 68 surrounding the bulkhead and in communication with the openings. Thus, fluid 50 can flow through the passage 62 from a lower section 42*b* of the washpipe 42, outward through the openings 66 below the bulkhead 64, through the annular space 68, inward through the openings 66 above the bulkhead, and through the passage to an upper section 42*a* of the washpipe.

The annular space 68 is formed as an internal radially enlarged portion of an outer sleeve 70 reciprocably disposed on a mandrel 72 having the bulkhead 64 formed therein. The sleeve 70 has resilient collets 74 formed thereon, with each collet having a radially enlarged engagement structure 76 formed thereon. Other types of releasable engagement devices may be used, if desired.

In the FIG. 3 example, the structures 76 are dimensioned appropriately for engagement with a structure 56 in the completion string 12. For example, with the collet fingers 74 not biased inwardly or outwardly, the structures 76 can have an outer radius or lateral dimension which is greater than an inner radius or lateral dimension of the structure 56.

In this manner, when the valve 44 is displaced upward through the structure 56 (e.g., when displacing the service tool string 22 from the FIG. 2 reverse position to the FIG. 4 shift position described below), the structures 76 will engage the structure 56, thereby applying a downward biasing force to the sleeve 70. Shear pins (not shown), or another releasable securing means, may be used to resist downward displacement of the sleeve 70 relative to the mandrel 72, until a predetermined force level is reached, in order to prevent inadvertent displacement of the sleeve.

Figure 4:
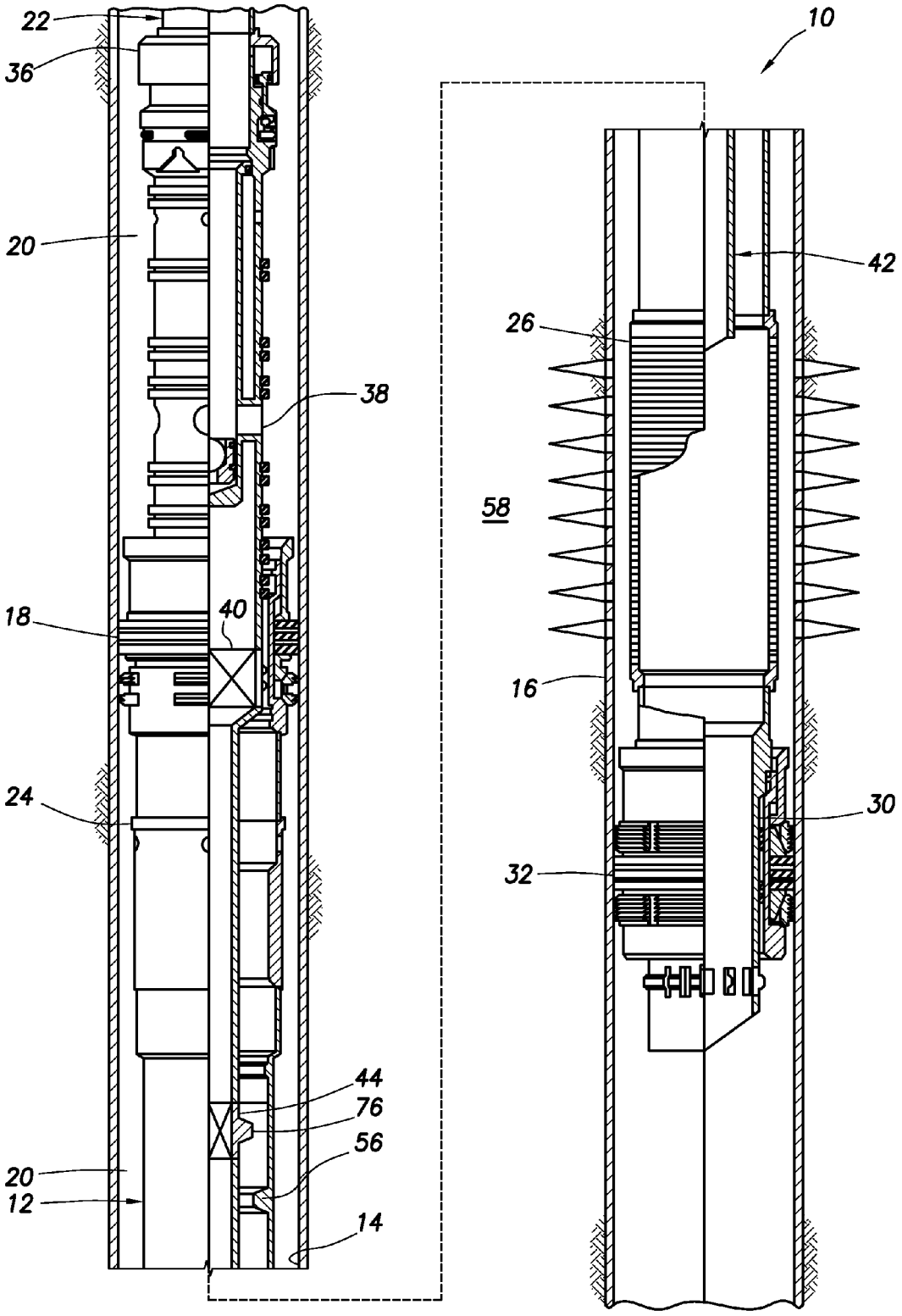
FIG. 4 is a representative partially cross-sectional view of the system, wherein a valve depicted in FIG. 3 is shifted closed.

In FIG. 4, the system 10 is representatively illustrated with the service tool string 22 having been raised again somewhat relative to the completion string 12. Due to this further withdrawing of the service tool string 22 from the completion string 12, the valve 44 engages and passes through the structure 56 (such as a radially reduced profile, etc.) in the completion string, thereby closing the valve. In this configuration, flow through the washpipe 42 is prevented and, thus, flow of fluid 50 into the screen 26 is also prevented.

Figure 5:
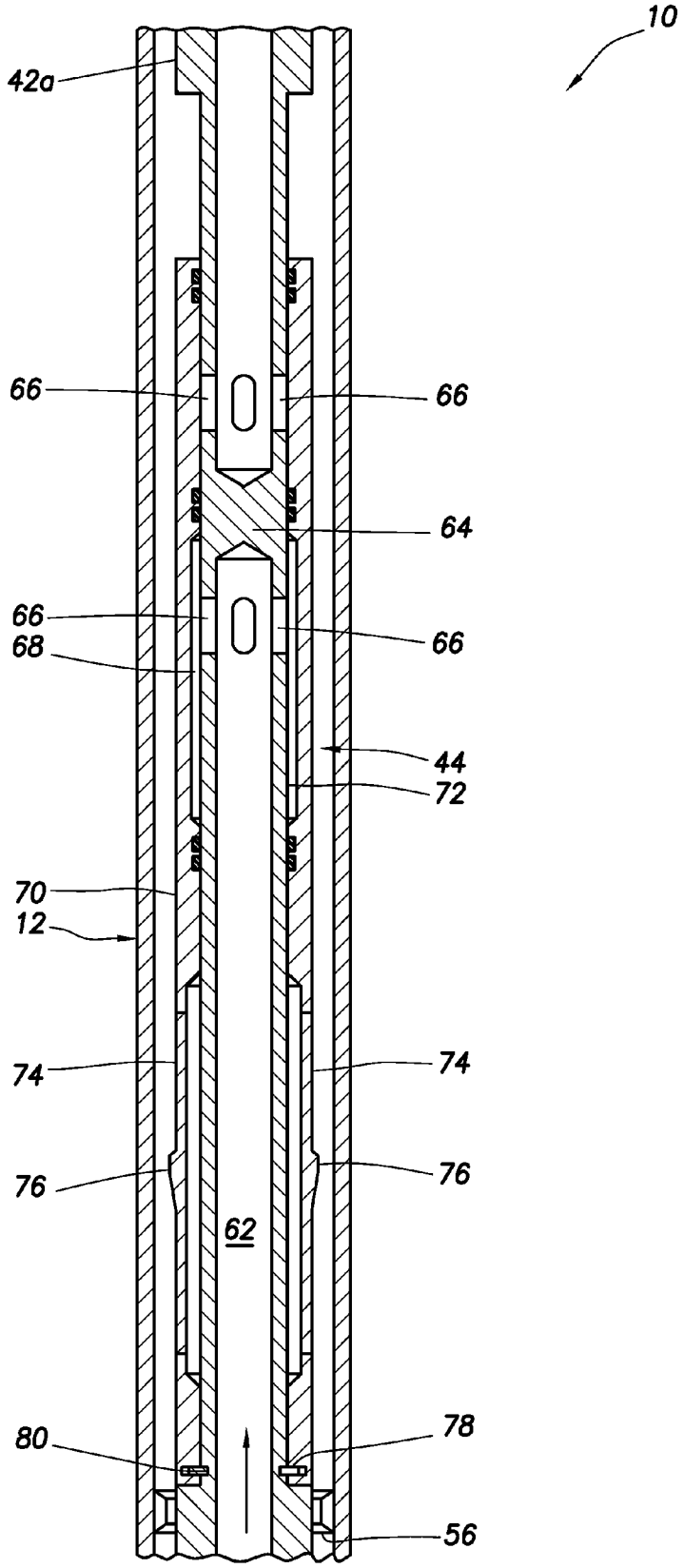
FIG. 5 is an enlarged scale representative cross-sectional view of the completion string and the service tool string, with the valve in its closed position.

Referring additionally now to FIG. 5, the valve 44 is depicted after it has been displaced upwardly past the structure 56. Note that the sleeve 70 has displaced downward relative to the mandrel 72, due to the sleeve being biased downward by the engagement between the structures 56, 76 while the valve 44 displaced upward.

A snap ring 78 carried in the sleeve 70 can engage a groove 80 on the mandrel 72 to prevent subsequent upward displacement of the sleeve relative to the mandrel. Any other type of locking device (e.g., a body lock ring, etc.) may be used, as desired.

In the FIG. 5 position of the sleeve 70, flow through the passage 62 is prevented. The annular space 68 no longer provides for fluid communication between the openings 66 on either side of the bulkhead 64. The valve 44 is in this closed configuration in the FIG. 6 squeeze configuration, and in the FIG. 7 reversing configuration, which are described more fully below.

Figure 6:
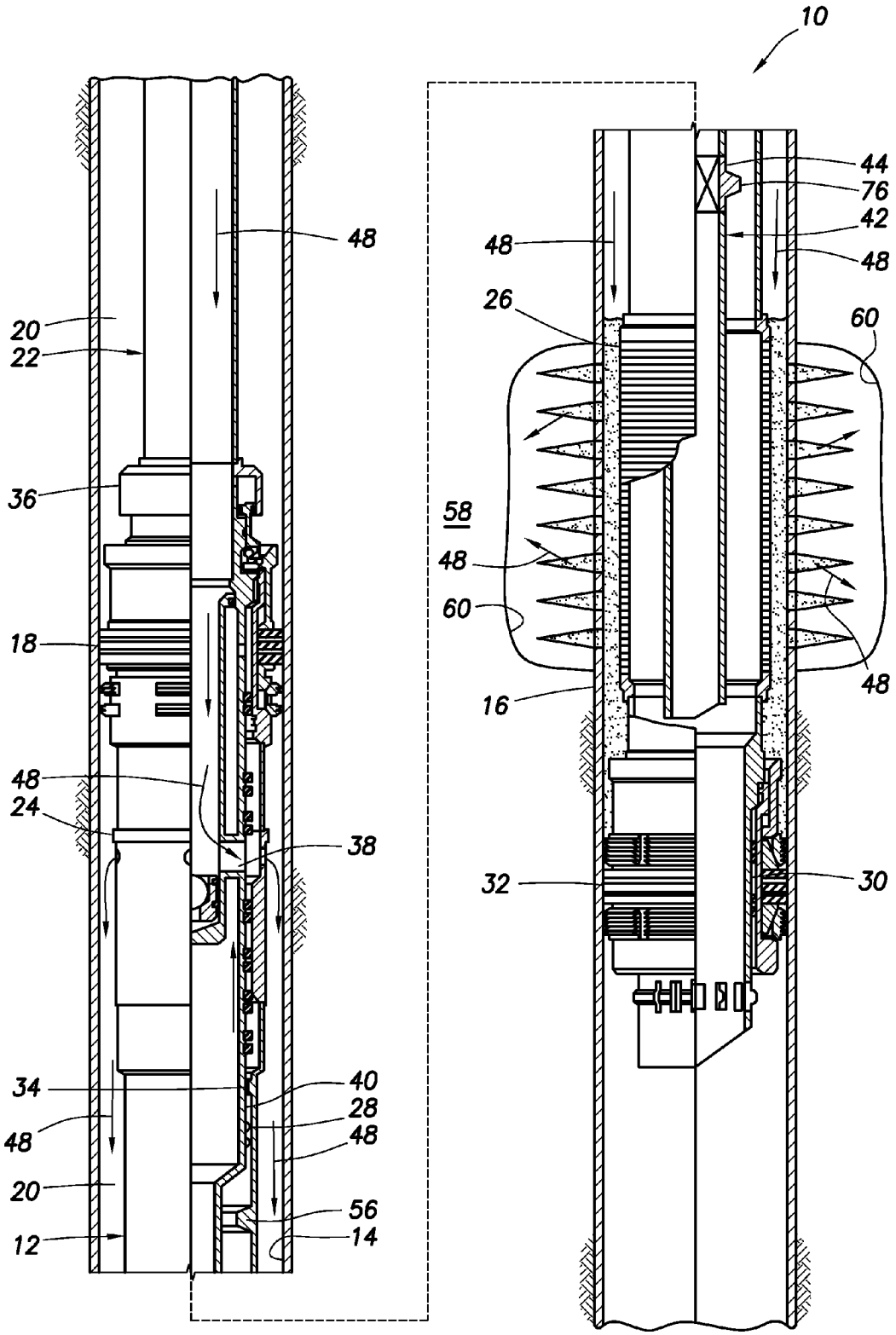
FIGS. 6 & 7 are representative partially cross-sectional views of the system in squeeze and reversing configurations thereof.

In FIG. 6, the system 10 is depicted after the service tool string 22 has been lowered again from its FIG. 4 shift position to its FIG. 1 circulate position relative to the completion string 12. In the FIG. 6 configuration, the valve 44 has been closed. The valve 40, however, is reopened when the engagement structure 28 thereon passes downwardly through the profile 34 when the service tool string 22 is displaced from the FIG. 4 shift position to the FIG. 1 circulate position.

The FIG. 6 squeeze configuration allows the slurry 48 (which may comprise proppant) to be flowed outward into the formation 58 surrounding the wellbore 14. Sufficient pressure may be applied to form fractures 60 into the formation 58, although the forming of fractures is not necessary in keeping with the scope of this disclosure.

If desired, the service tool string 22 can be displaced to the FIG. 4 shift position, and then to the FIG. 6 squeeze position after a mini-frac test, and prior to pumping a gravel slurry into the annulus 20 about the screen 26. A mini-frac test is an injection-falloff diagnostic test performed without proppant, before a main fracture stimulation treatment.

The intent, typically, is to break down the formation to create a short fracture during the injection period, and then to observe closure of the fracture system during the ensuing falloff period. Historically, these tests are performed immediately prior to the main fracture treatment to obtain design parameters (e.g., fracture closure pressure, fracture gradient, fluid leak-off coefficient, fluid efficiency, formation permeability and reservoir pressure).

Figure 7:
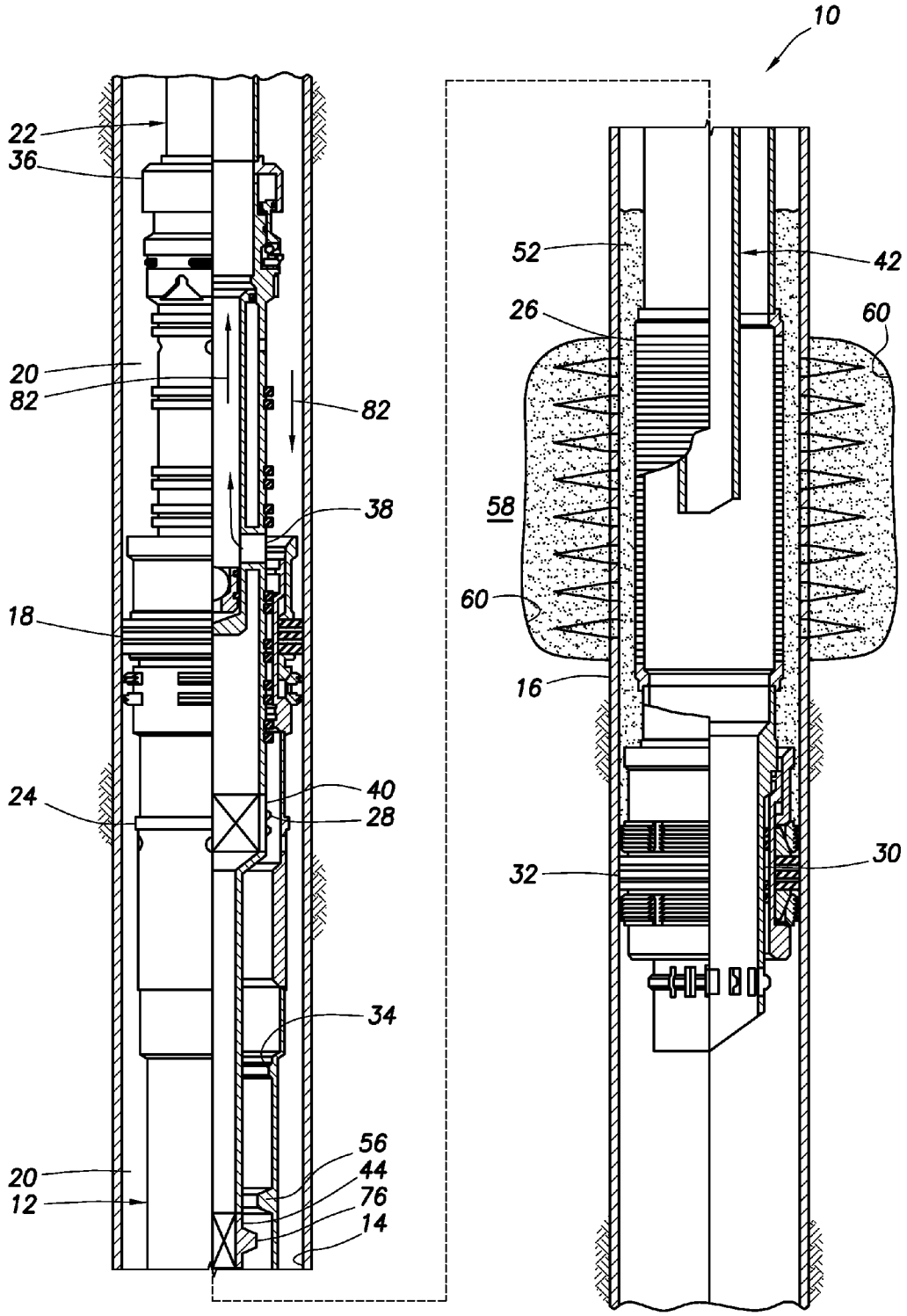

In FIG. 7, The service tool string 22 is raised again relative to the completion string 12, so that fluid communication between the interior of the service tool string above the packer 18 and the annulus 20 above the packer is permitted via the crossover 38. Clean fluid 82 can now be reverse circulated through the annulus 20 and the interior of the tool string 22 via the crossover 38, to thereby remove any proppant, gravel, sand, debris, etc. therein prior to retrieving the tool string to the surface.

The FIG. 7 reverse position of the service tool string 22 is essentially the same as the FIG. 2 reverse position, but in FIG. 7 the valve 44 in the washpipe 42 is closed. However, the valve 40 is also closed in the FIG. 7 reverse position of the service tool string 22. In other examples, only one of the valves 40, 44 (or another valve) may be closed in a reversing configuration.

Note that the service tool string 22 can be displaced to a reversing configuration from any of the other FIG. 1 circulate or FIG. 6 squeeze configurations.

It can now be fully appreciated that significant advancements are provided to the art by the above disclosure. Note that the circulating, squeezing and reversing operations depicted in FIGS. 1, 2, 6 & 7 can be performed with minimal displacement of the service tool string 22 relative to the completion string 12. This helps to reduce the overall length of the service tool and completion strings 22, 12, which reduces costs, reduces installation time, and enhances the convenience and reliability of operations.

Furthermore, it is not necessary for the service tool string 22 to be inserted further into the completion string 12 when converting from the circulating configuration to the squeeze configuration, and then partially withdrawn from the completion string when converting from the squeeze configuration to the reversing configuration. Instead, the service tool string 22 is merely withdrawn somewhat from the completion string 12 to the FIG. 4 position, and then lowered back to the circulate position (now the squeeze position), when converting from the circulating configuration to the squeeze configuration.

The above disclosure provides to the art a method which, in one example, can include closing a valve 44 interconnected between sections 42*a,b* of a washpipe 42 of a service tool string 22 by displacing the service tool string 22 relative to a completion string 12, thereby preventing flow through the washpipe 42.

The method can also include placing gravel 52 in an annulus 20 surrounding a well screen 26 of the completion string 12, after closing the valve 44.

Closing the valve 44 may include engaging a structure 56 of the completion string 12. The structure 56 may comprise a radially reduced profile in the completion string 12.

The displacing can include partially withdrawing the service tool string 22 from the completion string 12.

The service tool string 22 may include a crossover 38 which directs flow outward from the service tool string 22, and one of the sections 42*a,b* of the washpipe 42 can be interconnected between the crossover 38 and the valve 44.

The method can include positioning the valve 44 within a well screen 26 of the completion string 12. This positioning may be performed prior to the closing of the valve 44.

The method may include closing a second valve 40 interconnected between the crossover 38 and the washpipe 42. The second valve 40 can close in response to partially withdrawing the service tool string 22 from the completion string 12. The second valve 40 may open in response to inserting the service tool string 22 further into the completion string 12.

Also described above is a well system 10. In one example, the system 10 can include a service tool string 22 reciprocably received in a completion string 12, the service tool string 22 including a washpipe 42 received in a well screen 26, and a valve 44 which selectively permits and prevents flow through the washpipe 42.

The completion string 12 can include a structure 56 which operates the valve 44 in response to displacement of the service tool string 22 relative to the completion string 12. Once closed, the valve 44 cannot be reopened in the system 10.

The valve 44 may be interconnected between sections 42*a,b* of the washpipe 42. The displacement can comprise partial withdrawal of the service tool string 22 from the completion string 12.

Another method can comprise closing first and second valves 44, 40 by partially withdrawing a service tool string 22 from a completion string 12, thereby preventing flow through a washpipe 42 of the service tool string 22, then opening the second valve 40, but not the first valve 44, by inserting the service tool string 22 further into the completion string 12.

The method can also include placing gravel 52 in an annulus 20 surrounding a well screen 26 of the completion string 12, after closing the first valve 44.

Also described above is a method of treating a subterranean well. The method can comprise: positioning a service tool string 22 in a circulate position relative to a completion string 12, whereby a fluid 50 (e.g., included in the slurry 48) can be circulated from the service tool string 22 to an annulus 20 formed radially between the service tool string 22 and a wellbore 14; and then positioning the service tool string 22 in a squeeze position relative to the completion string 12, whereby the fluid 50 can flow via the service tool string 22 to a portion of the annulus 20 surrounding the completion string 12, but the fluid 50 cannot flow to a portion of the annulus 20 above the completion string 12 (e.g., above the packer 18). The service tool string 22 is not further inserted into the completion string 12 beyond the circulate position between the step of positioning the service tool string 22 in the circulate position and the step of positioning the service tool string 22 in the squeeze position.

The method can include positioning the service tool string 22 in a reverse position relative to the completion string 12, whereby a clean fluid 45, 82 can be flowed from the annulus 20 into the service tool string 22.

The circulate position is, in one example, at a same longitudinal position of the service tool string 22 relative to the completion string 12 as the squeeze position.

The service tool string 22 may be partially withdrawn from the completion string 12, between the step of positioning the service tool string 22 in the circulate position and the step of positioning the service tool string 22 in the reverse position.

The method may include further withdrawing the service tool string 22 from the completion string 12 beyond the reverse position, thereby closing a valve 44 and preventing flow through a washpipe 42 of the service tool string 22.

The step of positioning the service tool string 22 in the squeeze position can be performed after the step of closing the valve 44. The service tool string 22 may be inserted further into the completion string 12, between the step of closing the valve 44 and the step of positioning the service tool string 22 in the squeeze position.

The service tool string 22 may be partially withdrawn from the completion string 12, between the step of positioning the service tool string 22 in the squeeze position and the step of positioning the service tool string 22 in the reverse position.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A method, comprising:

closing a first valve interconnected between sections of a washpipe of a service tool string by displacing the service tool string relative to a completion string, such that once the first valve is closed the first valve cannot be reopened by displacing the service tool string, thereby preventing flow through the washpipe.

2. The method of claim 1, further comprising placing gravel in an annulus surrounding a well screen of the completion string, after closing the first valve.

3. The method of claim 1, wherein closing the first valve further comprises engaging a structure of the completion string.

4. The method of claim 3, wherein the structure comprises a radially reduced profile in the completion string.

5. The method of claim 1, wherein the displacing comprises partially withdrawing the service tool string from the completion string.

6. The method of claim 1, wherein the service tool string includes a crossover which directs flow outward from the service tool string, and wherein one of the sections of the washpipe is interconnected between the crossover and the first valve.

7. The method of claim 6, further comprising closing a second valve interconnected between the crossover and the washpipe.

8. The method of claim 7, wherein the second valve closes in response to partially withdrawing the service tool string from the completion string, and wherein the second valve opens in response to inserting the service tool string further into the completion string.

9. A method, comprising:

closing first and second valves by partially withdrawing a service tool string from a completion string, such that once the first valve is closed the first valve cannot be reopened by displacing the service tool string, thereby preventing flow through a washpipe of the service tool string; and then opening the second valve, but not the first valve, by inserting the service tool string further into the completion string.

10. The method of claim 9, further comprising placing gravel in an annulus surrounding a well screen of the completion string, after closing the first valve.

11. The method of claim 9, wherein closing the first valve further comprises engaging a structure of the completion string.

12. The method of claim 11, wherein the structure comprises a radially reduced profile in the completion string.

13. The method of claim 9, wherein the service tool string includes a crossover which directs flow outward from the service tool string, and wherein a section of the washpipe is interconnected between the crossover and the first valve.

14. The method of claim 9, further comprising positioning the first valve within a well screen of the completion string.

15. The method of claim 9, further comprising interconnecting the first valve between sections of the washpipe.

* * * * *